US006004900A

United States Patent [19]

O'Brien, III

[11] Patent Number: 6,004,900

[45] Date of Patent: Dec. 21, 1999

[54] COMPOSITE ARTICLE FOR SUBLIMATION-PRINTING AND METHOD OF MANUFACTURE

[75] Inventor: Frank O'Brien, III, North Falmouth, Mass.

[73] Assignee: Fiberspar, Inc., West Wareham, Mass.

[21] Appl. No.: 08/916,489

[22] Filed: Aug. 22, 1997

[51] Int. Cl.[6] ..... B41M 5/035; B41M 5/38

[52] U.S. Cl. ..... 503/227; 428/195; 428/207; 428/913; 428/914

[58] Field of Search ..... 8/471; 428/195, 428/206, 207, 328, 913, 914; 503/227

[56] References Cited

U.S. PATENT DOCUMENTS

| | | | |
|---|---|---|---|
| Re. 35,081 | 11/1995 | Quigley | 428/36.2 |
| 5,048,441 | 9/1991 | Quigley | 114/90 |
| 5,188,872 | 2/1993 | Quigley | 428/36.2 |
| 5,437,755 | 8/1995 | Lavorel et al. | 156/240 |

FOREIGN PATENT DOCUMENTS

| | | | |
|---|---|---|---|
| 5-270150 | 10/1993 | Japan | 503/227 |
| 2 224 974 | 5/1990 | United Kingdom | 503/227 |
| WO 91/08907 | 6/1991 | WIPO | 503/227 |

*Primary Examiner*—Bruce H. Hess
*Attorney, Agent, or Firm*—Lahive & Cockfield LLP

[57] ABSTRACT

A composite article and a method of manufacture for a composite article which includes an outer layer having optically-light coloration, thereby providing an outermost surface ready for application of visually-distinct sublimation print are described.

5 Claims, 2 Drawing Sheets

COMPOSITE ARTICLE FOR SUBLIMATION-PRINTING AND METHOD OF MANUFACTURE

BACKGROUND OF THE INVENTION

This invention relates in general to articles of composite materials suitable for imprinting with sublimation dyes, and to a method of manufacturing such composite articles.

The manufacture of structural elements and other articles from composite materials, with high strength fibers embedded in a polymer matrix, is known in the art. Such composite materials have excellent strength to weight characteristics and wide application.

Known processes for the manufacture of such composite articles generally include forming a series of layers or plies, where each ply may be the same or different, and where the fibers in each ply may be wrapped with different orientations or braiding patterns to meet the requirements of a particular structure. The processes employed and the apparatus for practicing these processes are known to those skilled in the art. They include a pultrusion process and a resin transfer molding process. Fiber materials which have been employed in the art include aramid, glass, carbon, or graphite, as well as materials such as ceramics and boron. The polymer matrix material typically is a thermoset resin such as polyester or epoxy resin. Alternatively, a variety of thermoplastic resins such as nylon, polypropylene, polycarbonate and the like have been used.

Sublimation-printing is a technique to imprint indicia in the form of designs, logos, characters, etc. into an article. Generally, a sublimation dye is encapsulated by an inert carrier that releases the dye into the surface of the article upon application of an external force. The encapsulated dye is contacted with the article and an external force, such as heat and/or pressure, is applied to rupture the carrier, causing the dye to migrate directly into the surface of the article.

Many manufactured articles require labeling on an external surface for environmental, aesthetic, identification or safety purposes. Quite frequently, the surface of the article does not lend itself to imprinting with indicia that are visually distinct and highly perceptible. For example, the composite can have an optically dark surface, due to coloration of the constituent resins and fiber, i.e., the optical quality is inherent. Therefore, a surface coating of an optically light color is desired before imprinting indicia by sublimation. Otherwise, indicia are visually indistinct, or of low distinctiveness, from the surface of the composite.

Coatings previously used in making the composite surface optically light include pigmented paints and the like. After coating the composite surface with such an optically-light material, a sublimation dye is transferred to the coated surface of the composite, leaving the image imprinted into the coated surface. Consequently, the current state of the art for the preparation of composite articles having an outermost surface which provides an optically-light color for application of visually-distinct sublimation print requires at least three steps. These steps include forming the article, coating the surface of the article with an optically-light surface ready for application of visually-distinct sublimation print, and sublimation printing.

The term "into", as used herein, means that the sublimation dye penetrates and/or coats the outer surface of the article.

Accordingly, an object of this invention is to provide a method for forming a composite article having a surface that is ready for visually-distinct sublimation print.

A further object of this invention is to provide a composite article that has a surface ready for visually-distinct sublimation print.

Other general and specific objects of the invention will in part be obvious and will in part appear hereinafter.

SUMMARY OF THE INVENTION

The invention attains the foregoing objects by providing a composite article that has a print-ready surface formed by a resin matrix. The resin matrix includes a selected coloration or other additive to attain the print-ready surface for receiving directly sublimation print with high visual contrasts and/or visual distinctiveness.

The invention, in addition, provides a method for this manufacture of such a composite article having a print-ready surface.

The surface of an article according to the invention, or manufactured according to the invention, can receive sublimation print directly, i.e., without an intermediate coating or other layer, and yet the printed indicia have high visual distinction and/or contrast relative to that surface.

The invention accordingly relates to a composite article and to a method of manufacture for a composite article that includes an outer layer having optically-light coloration, thereby providing an outermost surface ready for the application of visually-distinct sublimation print.

According to one feature, the invention provides a method for preparing a composite article. The method includes the steps of forming at least an outer layer of the article with a resin mixture that includes an effective amount of an optically-light pigment. The composite article is formed with an outermost surface which has optically-light coloration, thereby providing the outermost surface ready for application of visually-distinct sublimation print. Generally, an effective amount of the optically-light pigment in the outer layer is between about one and five weight percent based upon the total weight of resin in that layer. As an illustrative example, the pigment can be or include titanium dioxide.

The outer layer that includes the selected pigment or other coloration typically is a constituent part of the article, as distinguished from a layer or coating that is applied to the otherwise complete article and only or primarily for coloration purposes. That is the article would normally include the aforesaid outer layer for purposes of completing the structure of the article, even if it were not to be labeled or decorated or otherwise to receive sublimation print.

A further feature is that the invention provides a composite article that includes an integrally formed outer layer, with the outer layer comprising a resin mixture that includes a resin and an effective amount of an optically-light pigment or other coloring agent, thereby providing an outermost surface which is ready for the application of visually-distinct sublimation print.

According to yet another feature, the invention is directed to a method of preparing a composite article. The method includes the step of forming a resin mixture for an outer layer of the article, wherein the resin mixture includes a resin and an effective amount of an optically-light pigment or other coloring agent. The resin mixture is combined with a support, e.g. a mandrel on which the article is formed or one or more previously-fabricated resin-fiber plies of the article, thereby forming the composite with an outermost surface ready for application of visually-distinct sublimation print. In one illustrative practice of the invention, the resin mixture can include a curing agent, such as polyalkylamines.

In another embodiment, the invention provides a composite article. The article has an outer ply or other layer formed with a resin mixture for providing the composite article with an outermost surface ready for the application of visually-distinct sublimation print.

The invention thus provides an outermost surface of a composite article which is ready for the direct application of visually-distinct indicia and/or distinct sublimation print. The composite article therefore typically has an optically-light colored surface which is ready for the direct application of one or more sublimation dyes. The outermost surface of the composite article does not require an additional coating step with a light-colored pigment as heretofore required to attain a visually-distinct sublimation print.

The composite article and the method of the invention thus provide several advantages over those known in the art. The invention eliminates the need for the application of an optically-light colored coating to the surface of the composite. Further, this invention allows one skilled in the art to apply sublimation print directly to the outermost surface of a composite article in a continuous process with the fabrication of the article.

BRIEF DESCRIPTION OF THE DRAWINGS

For a fuller understanding of the nature and objects of the invention, reference is to be made to the following detailed description and the accompanying drawings, in which.

DESCRIPTION OF ILLUSTRATED EMBODIMENTS

The invention, according to one aspect, relates to a composite article and to a method of manufacture for a composite article which includes an outer layer which has optically-light coloration, thereby providing an outermost surface ready for the direct application of visually-distinct sublimation print.

Many different types of articles, such as hockey sticks, sail masts, boat hulls, the outer skins of airplanes, etc. can be prepared using composite materials. Each of these articles often requires some type of labeling or decoration for identification, warning, or advertisement. For example, hockey sticks are often emblazoned with informational and promotional print, together with the manufacturer's name and/or the manufacturer's logo. Similarly, a sail mast may bear a manufacturer's logo and/or consumer information.

Likewise, the outer surface of an airplane often requires labeling to warn operators of hazards and of safety features, or to display the airline's logo for advertisement.

One difficulty in applying such indicia to an outer surface of these articles of composite material is that the articles must first have an optically-light colored surface to contrast visually with the applied indicia. For example, in the case of either a hockey stick, a sail mast, a boat hull, or the outer surface of an airplane, the underlying composite may be opaque and/or dark in color. Therefore, prior to the application of indicia, the surfaces of these composite articles typically are first treated with an optically-light coating, such as a paint. This requirement to first paint the composite surface, followed by an additional step of applying indicia, adds significant manufacturing cost. The present invention avoids such problems.

Figure 1:
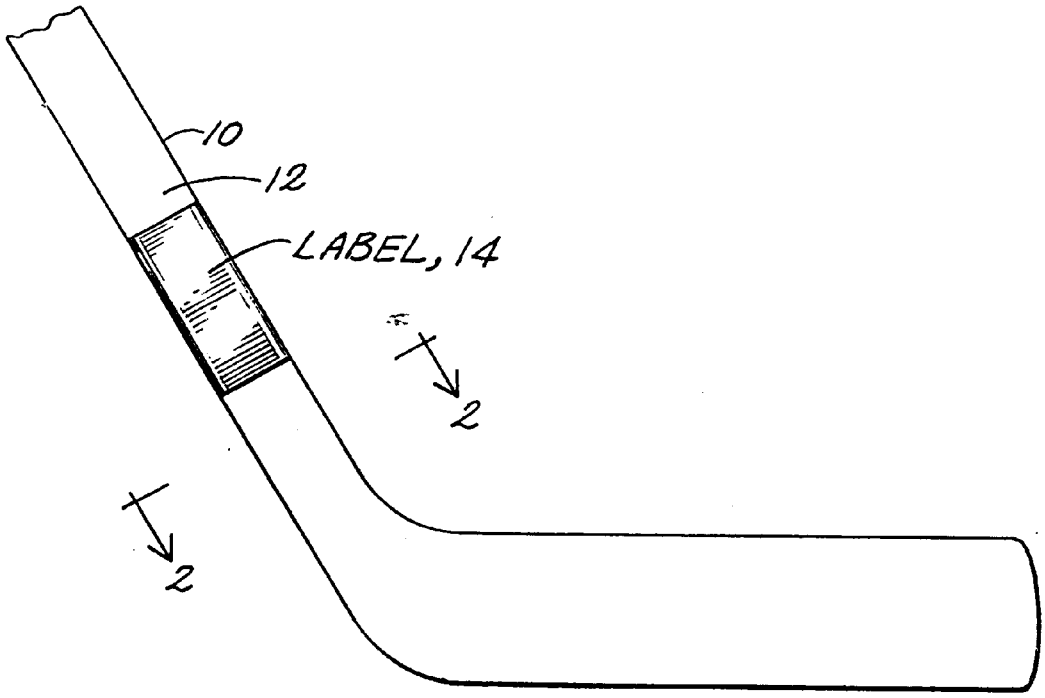
FIG. 1 shows the assembly of a hockey stick with sublimation print thereon in accord with one practice of the invention.

As one illustration of the present invention, FIG. 1 shows a composite member 10 such as a hockey stick. The composite hockey stick 10 includes an outermost surface 12 ready for the application of visually-distinct sublimation print. Sublimation print, such as indicia 14, is applied to the outermost surface 12. Typical depths of penetration of the sublimation dye into the outermost surface 12 are between about 0.01 mm and about 5 mm, preferably between about 1 mm and about 2 mm.

Figure 2:
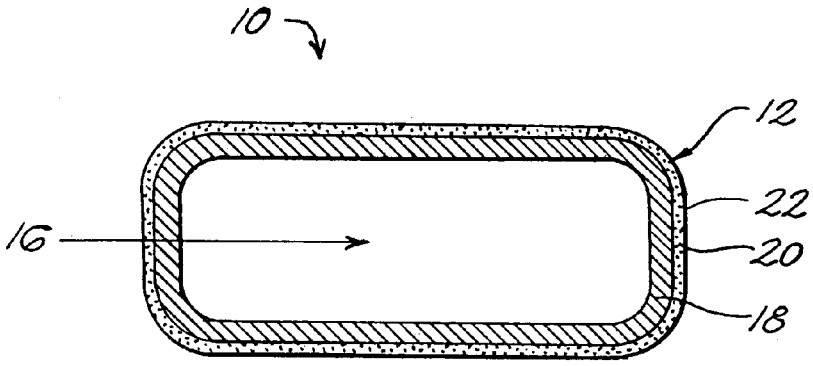
FIG. 2 shows a cross-sectional view of the composite hockey stick of FIG. 1 along the section line 2—2.

With reference to the cross-sectional view of FIG. 2, the illustrated composite hockey stick 10 includes a core 16, which is typically hollow. The illustrated core 16 can be formed with one or more resin-fiber plies and surrounded by an optional intermediate ply 18, preferably of fiber reinforced composite material. An outermost ply 20 typically includes structural fibers and/or a fibrous veil embedded in resin. The resin of the plies 16, 18 and 20 can be thermoplastic or thermoset.

In accord with the invention, the outer surface 12 of the composite hockey stick 10, as manufactured, is ready for sublimation print directly thereon.

The outer ply 20 can be formed with structural fibers, e.g., reinforcing fibers, a resin mixture that includes an effective amount of an optically-light pigment, such as titanium dioxide ($TiO_2$) and a resin, thereby providing an outermost surface 12 that is ready for the direct application of visually-distinct sublimation print. The term "effective amount" of optically-light pigment, as used herein, means an amount of pigment that, when added to the resin, imparts a visually-distinct quality to outermost surface 12 so that sublimation dye, when applied, is visually perceptible.

In one embodiment, the composite member 10 includes a hollow core 16 and an outer ply 20 without the optional intermediate ply 18. The outer ply 20 fibers includes fibers combined with a resin mixture that includes an effective amount of an optically light pigment dispersed throughout a resin.

Pigments include those typically utilized in ceramic, paint and coatings applications. The term pigment, as used herein, denotes any solid or liquid substance that reflects light of selected wavelength(s), while absorbing light of other wavelengths, without producing appreciable luminescence, thereby imparting color to the underlying material. Pigments for this practice of the invention include metal oxides and dioxides, clays, silica and liquid dispersions thereof as are known in the art.

Suitable examples of pigments include mica, tiantium dioxide, iron oxide and mixtures thereof. A preferred combination of pigments is a mixture of mica, titanium dioxide and iron oxide with colorants (Cres-Lite Pearlescent Pigments, Product Numbers 761–771, Crescent Bronze Powder Co., Chicago, Ill.). A preferred liquid dispersion is a dispersion of titanium dioxide (75 percent by weight) in 1-methoxy-2-propanol acetate (23 percent by weight) and naphthol spirits (2 percent by weight) (Morton International, Lansing Ill., Product number UCD 1030 V).

The particle size of the pigment can vary from between about 0.1 microns and about 200 microns. Generally, the pigment does not detract from the physical properties of the underlying composite structure. Therefore, an amount of pigment which causes the outermost surface to be brittle, flake or which otherwise detracts from the desired operational and functional characteristics, e.g., strength or flexibility or reliability, of composite article 10 is generally not an effective amount. In one embodiment, the effective amount of pigment is between one and five weight percent, based upon the total weight of the resin.

Suitable materials for the resin constituent are principally polymers which penetrate and bond fibers and which have appropriate mechanical properties such as stiffness, strength and glass transition temperature. These include thermoplastic materials such as polyphenylene sulfide, polyether sulfone, polyethylene terephthalate, nylon, polypropylene, polycarbonate and acetals; and further include thermoset materials such as polyepoxies, polyvinyl esters or polyester resins, catalyzed by anhydrides, polyamides or aliphatic amines. For example, a preferred resin is an aliphatic diglycidyl ether (Shell EPON Resin 9500, Shell Chemical Co., Product Code 44153).

A curing agent can be mixed with the resin and/or fiber(s). The curing agent helps to accelerate the rate of cure of the resin and can crosslink the resin mixture. Suitable curing agents are known to those of skill in the art. A preferred curing agent for polyethers, such as aliphatic diglycidyl ethers, is a polyalkylamine (Shell, Chemical Co., Product Code 44637). Typically, 20–35 weight percent of the curing agent is added to 100 parts of resin in a resin mixture.

Typical composite articles produced by the method of the invention contain, in the outer layer or ply that forms the print-receiving surface, between about 20 and about 99 weight percent of the resin mixture, and preferably between about 35 and about 40 weight percent of the resin mixture.

A variety of fibers can be employed in composite articles with which the invention is practical, including but not limited to aramid, carbon, graphite, glass, boron and ceramics. The fibers can be aligned in various fashions. For example, the fibers can be interwoven with helically oriented fibers or they can be braided. Accordingly, the teachings of U.S. Pat. No. 5,188,872 and U.S. Pat. Reissue No. 35, 081 are incorporated herein by reference.

While specific patterns of fibers are not shown, it will be understood that a variety of patterns, from relatively simple arrangements such as circumferentially spaced axial fibers to more complex braids may suitably be employed. Also, the fibers may be positioned such that the orientation of the fibers prior to secondary processing is different from that after secondary processing. Such techniques are described in U.S. Pat. No. 5,048,441, which is incorporated herein by reference.

An alternative to a resin, for the preparation of the resin mixture for fabricating the outer print-receiving layer, involves the use of a low viscosity monomer and a catalyst, which are mixed with the pigment just prior to saturation of the support. The monomer is then polymerized to form the composite material having an optically-light colored outermost surface ready for the printing of indicia.

Suitable examples of monomers include acrylates, methacrylates and urethanes. Acrylates include methylacrylate, ethylacrylate and butylacrylate. Methacrylates include methyl methacrylate, ethyl methacrylate and hydroxyl ethyl methacrylate. Generally, urethane monomers can include polyols, such as polyether polyols and diisocyanates, such as toluene diisocyanate (TDI), diphenylmethane diisocyanate (MDI) and polymethylene polyphenyl isocyanate (PAPI). Additionally, more than one monomer can be used to form a matrix which is suitable for printing an optically-light colored outermost surface ready for the printing of indicia. The choice of acrylates, methacrylates or urethanes is often determined by the performance characteristics required of the composite article.

Examples of polymerization catalysts include azo compounds, peroxides and other free radical forming species which are capable of initiating a polymerization reaction between monomer molecules containing at least one degree of unsaturation. Typically, a suitable amount of catalyst is between about 0.1% and about 5.0% based on the total weight of monomer.

Crosslinking agents, such as ethylene glycol dimethacrylates, ethyl glycoldiacrylates, triethylene glycol dimethacrylate, triethylene glycol acrylate, triethylene glycol trimethacrylate and triethylene glycol triacrylate can also be added to acrylates and methacrylates to form thermoset compositions.

Generally, between about 0.1 and about 20% crosslinking agent based on a total weight of monomer is added to a monomer composition.

The term "visually-distinct," as used herein, means that a printing dye or ink, such as a sublimation dye, when imprinted onto the outermost surface 12, contrasts well enough with outermost surface 12 so that the imprint is visually perceptible and distinct, i.e. a viewer perceives a difference in optical density between the indicia 14 and the outermost surface 12.

The outermost layer 20 that forms the outermost surface 12, thus is made optically-light by pigmentation, preferably white for example by means of titanium dioxide incorporated into the resin during the manufacturing process. The pigmentation of the optically-light outermost layer 20, including the outermost surface 12, is intended to reveal super-imposed indicia 14, and is not limited to the color hite. The invention contemplates the entire range of translucent, metallic, or lightly olored dyes and inks.

Additionally, either or both the core 16 and the intermediate layer 18 can be fabricated to include optically-light pigment, such as titanium dioxide, within the resin mixture. Of course, the cross-sectional shape depicted in FIG. 2 is merely illustrative; and the invention can be practiced with composite articles of other tubular shapes as well as of non-tubular ones. Also, the invention can be practiced with composite articles having other than three layers of materials. One preferred practice of the invention contemplates a single layered composite article 10 that includes an outermost layer 20 as the sole layer and that has a visually-distinct outermost surface 12.

The sublimation dye technique is given as a preferred embodiment of the invention because it enables visually rich, and especially durable indicia to be applied to the optically-light outermost surface 12. Such indicia are particularly resistant to abrasion due to the ink gradient created in the surface of the article. If the thickness of the outermost layer is sufficient, one can obtain defined relief effects allowing, for example, a background motif and a foreground motif.

The invention extends to other techniques or methods of ink transfer, such as serigraphy, tampography, or also, heat marking, by way of example. Thus, any of these techniques can be utilized for the application of indicia 14 to the outermost surface 12.

Figure 3:
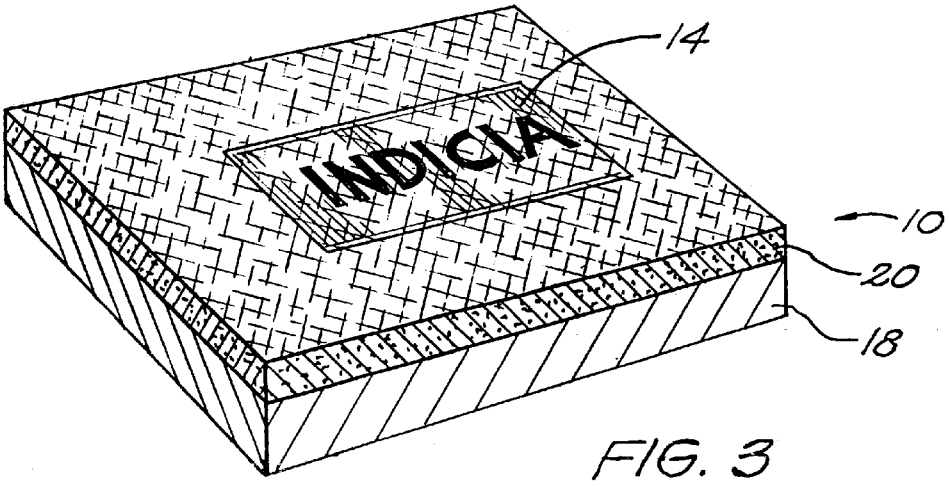
FIG. 3 illustrates a non-limiting example of the layered structure of a top portion of a composite article according to the process of the invention including indicia in the outermost surface by sublimation print.

FIG. 3, shows another composite article 10' having an outermost layer 20' that forms an outermost surface 12'. The illustrated article 10' further has indicia 14' imprinted or otherwise applied onto the outermost surface 12'. The visual effect of the indicia 14' can be defined, at least in part, according to the thickness of outermost layer 20', the penetration depth of the ink, and the nature of the outermost surface 12' with regard to the diffusion of the ink to provide a selected level of visual contrast.

The thicknesses of the outermost layer 20' preferably is greater than the penetration depth of the sublimation dye. The application of the ink can be performed in a continuous fashion, subsequent to the formation of the outer layer 20'. In one such practice of the invention, after the article 10' of FIG. 3 is fabricated with the layer 20' and the resin crosslinked or otherwise cured to receive the indicia 14', a sublimation carrier is placed on the surface 12' at a temperature of between about 370° C. and 400° C. is applied at a pressure of between about 0.1 psig and about 10 psig for approximately 10 to 90 seconds, preferably for approximately 60 seconds. The indicia-bearing article 10' can thus be fabricated and imprinted with indicia in a continuous sequence of operation.

Figure 4:
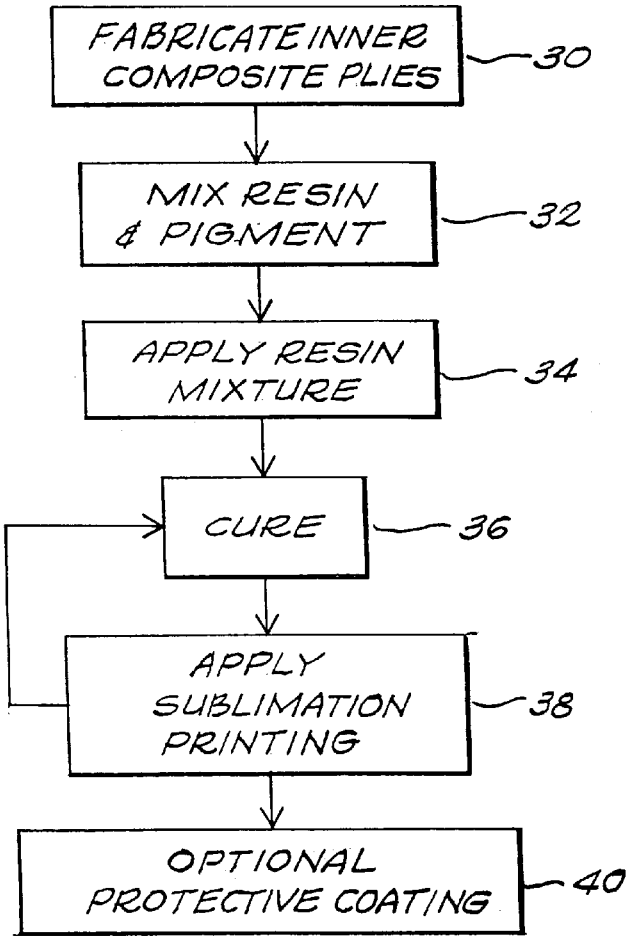
FIG. 4 is a flow chart of a sequence of steps illustrating a non-limiting example for a continuous process of forming a composite article according to the invention, including the application of sublimation print upon an outermost surface.

The process flowchart of FIG. 4 illustrates one such continuous fabrication and indicia applying process according to the invention. That is, FIG. 4 shows a continuous and preferably uninterrupted process to produce a single ply or a multi-ply composite article together with the direct application of a sublimation dye. The illustrative sequence of FIG. 4 includes an initial step 30 of fabricating any inner ply or plies of the composite article. This step can employ techniques known in the art and disclosed in the referenced documents incorporated herein by reference.

A further step 32 in accord with the invention involves mixing a resin or a monomer and/or a crosslinking agent with an optically light pigment to form a resin mixture, as described above. The resin-pigment mixture is applied to the outer surface of the previously fabricated plies, or of a mandrel if the article has only a single ply or layer, together with whatever fibers or other structural elements are present in an outermost layer of the composite article as indicated in step 34.

The next step illustrated in the flowchart of FIG. 4 is to cure the resin mixture of the composite article in a step 36. As known in the art, the curing step may be optional depending on the nature of the resin used in fabricating the article. The parameters of the curing step are selected according to known techniques in accordance with the resin of the article.

One typical curing step includes the application of a curing energy such as heat, pressure, ultraviolet light, gamma rays, electron beams, x-rays, neutron rays, microwave energy or infrared energy, alone or in combination and sequentially or simultaneously, as conventionally appropriate for the materials involved.

The illustrated four steps 30, 32, 34 and 36 prepare and complete the structural features and any cosmetic elements of the composite article, aside from indicia printed thereon. In particular, the application of the resin mixture according to step 34 provides the composite article with an outermost surface, such as the surface 12 in the article in FIG. 1, which is to receive printing.

To complete the illustrated method of the invention, sublimation print is contacted with the outermost surface 12 of the optically-light pigment. The sublimation dye is transferred into the outermost surface 12 by heat, pressure, or other physical process. One typical illustrative practice is to apply a pressure on the order of 0.1 psig at a temperature of 400° C. for 60 seconds. This or other known stimulus causes the sublimation dye to burst into the optically-light outermost surface 12. By this process, the sublimation dye diffuses into the outermost surface 12 and forms the desired indicia 14.

Optionally, subsequent to application of the sublimation print into the outermost surface 12, an additional protective coating can be applied to outermost surface 20 in step 40. Suitable examples of protective coatings include paint, lacquer and clear epoxy.

EXEMPLIFICATION

Preparation of a Sublimation Ready Article

FABRIC REINFORCEMENTS (from inside out)

| Ply # | Material Type | Slit Width | Seam | CVG # |
|---|---|---|---|---|
| Layer 1 | DB170 | 3.375 | TOP | 1 |
| Layer 2 | DB120 | 3.5 | BOTTOM | 2 |
| Layer 3 | Axial Reinforcement (See below) | | | |
| Layer 4 | GDB127 | 3.75 | TOP | 3 |
| Layer 5 | GT 100 | 4 | TOP | 4 |
| Layer 6 | NEXUS VEIL | 3 | TOP | 5 |
| Layer 7 | NEXUS VEIL | 3 | TOP | 5 |
| Layer 8 | NEXUS VEIL | 3 | BOTTOM | 6 |

Slit width refers to the width of fabric entering the die in inches. Seam refers to the orientation of the edges of the fabrics and spatially where they meet. CVG refers to a constant velocity guide which wraps a single layer of fabric about a mandrel. Each number refers to a CVG. Multiple CVGs are used to apply multiple layers of fabric or fibers. DB170 and DB120 are double biased fiber glass +/−45 degrees manufactured by Knytex, New Braunfels, Tex. GDB-127 is a double biased carbon fiber +/−45 degrees 6K strand manufactured by Knytex, New Braunfels, Tex. GT 100 is a 10 ounce glass tape of 4 inch width manufactured by Mutual Industries, Philadelphia, Pa. Nexus Veil is a 1 ounce polyester veil manufactured by Precision Fiber Glass, Greensboro, N.C.

AXIAL REINFORCEMENTS

| Material Type | | Total # Ends |
|---|---|---|
| Glass | 225 E-Glass | 8 |
| Carbon | 33 MSI 12K | 44 |

Total # Ends refers to the number of strands which enter the die, e.g. 8 total # ends requires that 8 bobbins of glass fibers are 225 E-Glass is a glass fiber manufactured by Fiber Glass Industries, Amsterdam, NY (product number: Flexstrand 700-225). 33 MSI 12K is manufactured by Grafil, Inc., Sacramento, Calif. (product number: 34-700 12K 1.2A).

BATCH FORMULATION

Part "A"

| P/N | Function | PPH | Wt. (g) | Wt. (lb) |
|---|---|---|---|---|
| Shell 9500 | Resin | 100 | 4000 | 8.81 |
| Axel 1846 | Internal Release | 3 | 120.0 | 0.26 |
| Byk-501A | Air Release | 0.27 | 10.8 | 0.02 |
| Byk-515A | Wetting Agent | 0.4 | 16.0 | 0.04 |

-continued

| P/N | Function | PPH | Wt. (g) | Wt. (lb) |
|---|---|---|---|---|
| ASP-400 | Filler | 40 | 1400.0 | 3.08 |
| White Dispersion | Color | 2 | 200 | 0.44 |

P/N is the commercial product number. PPH is parts per hundred. Shell 9500 (Shell Oil Company, product name: Epon Resin 9500, product code 44153, Aliphatic diglycidyl ether); Axel 1846 (Axel Plastics Research Laboratories, Inc., Woodside, N.Y., product name: Mold Wiz # INT-1846, condensation product of synthetic resins, glycerides and organic acid derivatives with copolymers of organic phosphate esters); Byk-501A (Byk-Chemie USA, Wallingford, Conn., product name: BYK-A 501, dialkyl adipate in light aromatic naphtha and 1-methoxy-2-propanol); Byk-515A (Byk-Chemie USA, Wallingford, Conn., product name BYK-A515A, polyether in butyl glycolate, stoddard solvent and 2-butoxyethanol); ASP-400 (Burgess Pigment Co., Sandersville, Ga., product name: Polyclay, $Al_2O_3$ $2SIO_2$/$2H_2O$); white dispersion (Morton International, Lansing, Ill., Product number: UCD 1030V, titanium dioxide).

Part "B"

| PIN | Function | PPH | Wt. (g) | Wt. (lb) |
|---|---|---|---|---|
| EP0N 1846 | Curing Agent | 33 | 1320.0 | 2.91 |
| PACM | Curing Agent | 3 | 120.0 | 0.26 |

P/N and PPH are as defined above. EPON 1846 (Shell Oil Company, product name: Epoxy Research Curing Agent RSC-1846, product code 44637, polyalkylamine) and PACM (Air Products, Allentown, Pa., product name: Amicure PACM curing agent, product code HPACMU, 4, 4'-methylenebiscyclohexanamine)

In separate containers, the components of Part "A" and Part "B" are combined until homogeneous. The resultant mixtures are then combined to form a resin mixture which is poured into a pressure pot. The resin mixture is added to the layers of material while the layers are pulled through the mold. Between 1–6 constant velocity guides (CVG's) are situated in front on the mold to serve as alignment guides for the layers of material and fibers. The CVG's permit the materials to be impregnated by the resin mixture and pulled through the mold in an even, uniform fashion for approximately 15 to 45 seconds prior to heat treatment. The resin treated layers/fibers are passed through a die having a temperature gradient of between about 320° F. and 380° F. at a rate of 16 inches/minute with a pull force of 2000 pounds. The resultant composite material is ready for application of visually distinct sublimation print.

It will thus be seen that the invention efficiently attains the object set forth above, along with those made apparent from the preceding description. It will be understood that changes may be made in the above constructions and in the foregoing sequences of operation without departing from the scope of the invention. It is accordingly intended that all matter contained in the above description or shown in the accompanying drawings be interpreted as illustrative rather than in a limiting sense. It is also to be understood that the following claims are intended to cover all of the generic and specific features of the invention as described herein, and all statements of the scope of the invention which, as a matter of language, might be said to fall there between.

Having described the invention, what is claimed or new and secured by Letters Patent is:

1. A composite article comprising an outermost ply formed integrally thereon, said outermost ply comprising fibers embedded in a resin mixture that includes a resin and an effective amount of optically-light pigment, the effective amount of the pigment being between about 1 and less than 5 weight percent based upon the total weight of the resin, thereby providing an outermost surface of said outermost ply which is ready for the application of visually-distinct sublimation print.

2. The composite article of claim 1 wherein the pigment is titanium dioxide.

3. The composite article of claim 1 wherein said composite outermost includes said visually-distinct sublimation print.

4. A method for preparing a composite, said method comprising the steps of forming a resin mixture, said resin mixture comprising an effective amount of optically-light pigment and a resin, the effective amount of the pigment being between about 1 and less than 5 weight percent based upon the total weight of the resin, and combining the resin mixture with a reinforcing fiber, thereby forming the composite having an outermost surface ready for application of visually-distinct sublimation print, and applying sublimation print to said outermost surface.

5. The method of claim 4 wherein the pigment is titanium dioxide.

* * * * *